US005088245A

United States Patent [19]

Anderson

[11] Patent Number: 5,088,245

[45] Date of Patent: Feb. 18, 1992

[54] INTERCONNECTED HEXAGONAL BUILDING STRUCTURES

[75] Inventor: Mark Anderson, Holland, Mich.

[73] Assignee: W. H. Porter, Inc., Holland, Mich.

[21] Appl. No.: 564,059

[22] Filed: Aug. 7, 1990

[51] Int. Cl.[5] ..... E04B 7/00

[52] U.S. Cl. ..... 52/82; 52/81; 52/648; 52/712; 403/251

[58] Field of Search ..... 52/82, 81, 80, 79.4, 52/712; 403/251

[56] References Cited

U.S. PATENT DOCUMENTS

| | | | |
|---|---|---|---|
| 2,270,161 | 1/1942 | Briggs . | |
| 2,461,916 | 2/1949 | Omar . | |
| 2,678,488 | 5/1954 | Erzer . | |
| 2,959,256 | 11/1960 | Deam | 52/236.1 |
| 3,177,618 | 4/1965 | Jacob . | |
| 3,308,596 | 3/1967 | Cooper et al. . | |
| 3,462,895 | 8/1969 | Wormser . | |
| 3,562,975 | 2/1971 | Moss . | |
| 3,810,342 | 5/1974 | Scott | 52/81 |
| 3,974,602 | 8/1976 | Pohl et al. . | |
| 4,011,697 | 3/1977 | Fedolfi . | |
| 4,078,341 | 3/1978 | Peterson et al. . | |
| 4,125,973 | 11/1978 | Lendrihas . | |
| 4,187,651 | 2/1980 | Tolsma . | |
| 4,271,654 | 6/1981 | Jungbluth . | |
| 4,275,534 | 6/1981 | Porter | 52/648 |
| 4,347,690 | 9/1982 | Wallace, Jr. . | |
| 4,395,154 | 7/1983 | Phillips | 52/80 |
| 4,575,974 | 3/1986 | Porter . | |
| 4,630,550 | 12/1986 | Weitzman . | |

FOREIGN PATENT DOCUMENTS

| | | |
|---|---|---|
| 471236 | 7/1914 | France . |
| 418613 | 2/1967 | Switzerland . |
| 126492 | 5/1919 | United Kingdom . |
| 142128 | 4/1921 | United Kingdom . |
| 2174430 | 5/1985 | United Kingdom . |

OTHER PUBLICATIONS

*Cover.All Pre-Engineered Carports and Shelters*, Publication of Cover-All, div. of W.H. Porter, Inc., 4240 N. 136th Ave., Holland, MI 49423, copyright Dec., 1983.

*Primary Examiner*—John E. Murtagh
*Attorney, Agent, or Firm*—Emrich & Dithmar

[57] ABSTRACT

An arrangement for interconnecting and supporting a pair of hexagonal building structures includes a pair of common support columns each having a hexagonal shaped connector tube mounted to an upper end thereof. Each connector tube includes apertures in each of the six lateral walls thereof which are adapted for receiving a nut and bolt combination for coupling the tube to the eave beams and roof trusses of two hexagonal building structures. The nut and bolt combinations are hidden from view within the connector tube and adjacent beams to provide a clean, attractive appearance and are not exposed to the elements. The use of common support columns and a common eave beam for adjacent hexagonal building structures simplifies assembly, reduces the number of structural components and building cost, and integrates two or more of such building structure for increased structural strength.

12 Claims, 1 Drawing Sheet

INTERCONNECTED HEXAGONAL BUILDING STRUCTURES

BACKGROUND OF THE INVENTION

This invention relates generally to the construction and assembly of building structures and is particularly directed to an interconnect arrangement for hexagonal building structures.

Building structures in the shape of a hexagon generally include six spaced support columns coupled at respective upper ends thereof by means of horizontal eave beams. Extending upward and inward from each of the support columns is a respective roof truss. The inner, upper ends of the roof trusses are connected to an inner compression ring. Similarly, the six eave beams form a tension ring. An example of such hexagonal building structures can be found in U.S. Pat. No. 4,275,534, assigned to the assignee of the present application.

In many cases for structural and aesthetic reasons, it is desirable to construct hexagonal building structures in an adjoining fashion to form an integrated structure comprised of a pair of adjacent, abutting hexagonal structures. In some cases the adjacent hexagons are connected together, while in other cases each hexagon is free standing with no connection to any other hexagonal building structure. In either case, two or more complete hexagonal building structures each including at least six support columns, six eave beams, and six roof trusses are required for the multi-hexagonal building structure.

The present invention provides improved interconnected hexagonal building structures which make use of a reduced number of structural elements by incorporating common elements in two adjacent interconnected hexagonal building structures. The interconnected hexagonal building structures of the present invention also employ a simplified interconnect arrangement which makes use of conventional nut and bolt connections which are disposed within the various building structural members and are thus hidden from view for improved aesthetics and are not exposed. to the elements.

OBJECTS AND SUMMARY OF THE INVENTION

Accordingly, it is an object of the present invention to provide an improved arrangement for securely and stably assembling and connecting a plurality of hexagonal building structures.

It is another object of the present invention to provide an inexpensive arrangement for assembling and connecting hexagonal building structures which employs a reduced number of components by using structural members common to both hexagons for the interconnection.

Yet another object of the present invention is to provide an interconnection arrangement for a plurality of adjacent hexagonal building structures wherein the connecting components are hidden from view and not exposed to the elements.

A further object of the present invention is to provide a high strength, lightweight tubular frame for hexagonal building structures and means for securely coupling together adjacent hexagonal building structures.

This invention contemplates a building structure comprising: a first hexagonal building structure including a first plurality or support columns, eave beams and roof trusses; a second hexagonal building structure including a second plurality of support columns, eave beams and roof trusses; first and second connecting means for coupling an eave beam and first and second support columns forming portions of the first and second hexagonal building structure and connecting the first and second hexagonal building structures.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
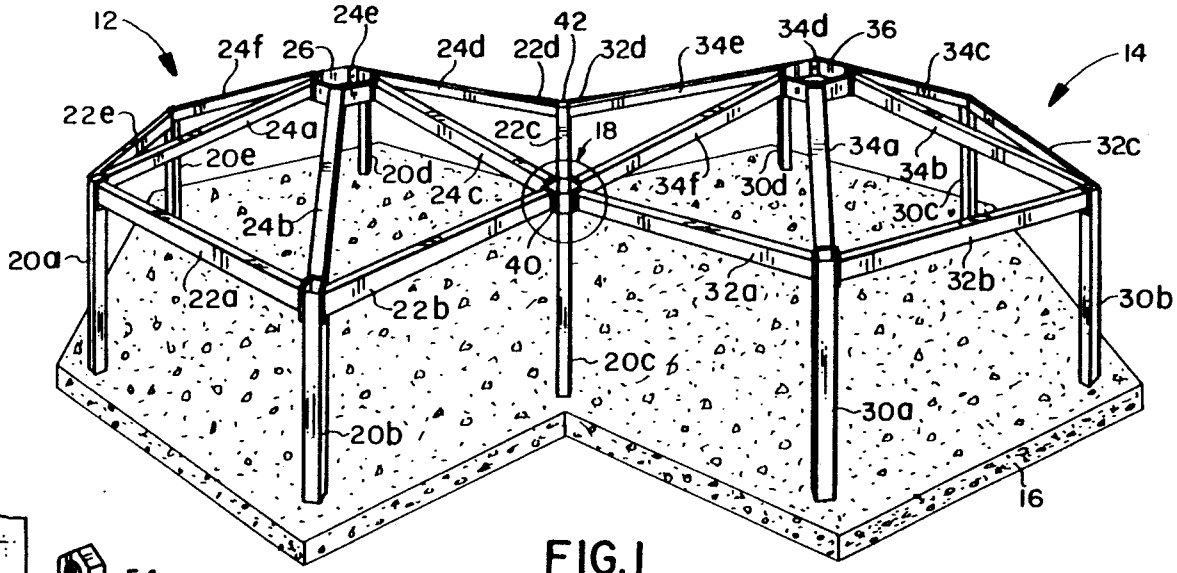
FIG. 1 is an upper perspective view of a pair of hexagonal building structures interconnected in accordance with the principles of the present invention.

Referring to FIG. 1, there is shown first and second hexagonal building structures 12 and 14 interconnected in accordance with the principles of the present invention. The first hexagonal building structure 12 includes six support columns, with five of the six support columns identified as elements 20*a*–20*e* and the sixth support column not shown in the figure as it is hidden by an eave beam 22*c*. A plurality of such eave beams identified as elements 22*a*–22*e* are connected to respective upper end portions of the support columns 20*a*–20*e*. Only five eave beams 22*a*–22*e* are shown in the figure, with a sixth eave beam interconnecting support columns 20*d* and 20*e* hidden by a roof truss 24*f*. A plurality of such roof trusses 24*a*–24*f* are disposed about an upper portion of the first hexagonal building structure 12 and are each coupled to a respective one of the support columns at one end thereof and to a first compression ring 26 at a second end thereof. The support columns 20*a*–20*e*, the eave beams 22*a*–22*e*, the roof trusses 24*a*–24*f*, and the first compression ring 26 are coupled together by conventional nut and bolt combinations. Each of the aforementioned beam structural members includes an end, or mounting plate, to facilitate attachment of the structural member to another stuctural member. Each of the support columns 20*a*–20*e* is oriented generally vertically and is positioned upon a base 16 which may be in the form of a concrete slab. Lower ends of each of the support columns 20*a*–20*e* may also be securely coupled to the base 16 by conventional means such as anchor bolts, which are not shown for simplicity.

Also shown in FIG. 1 is a second hexagonal building structure 14 positioned upon the base 16 and interconnected with the first hexagonal building structure 12 in accordance with the present invention. As in the case of the first hexagonal building structure 12, the second hexagonal building structure 14 also includes a plurality of generally vertically oriented support columns 30*a*–30*d*. Two support columns are shared by the first and second hexagonal building structures 12, 14 with one of these support columns shown as element 20c and the other shared support column hidden by eave beam 22c. A plurality of eave beams 32a–32f are coupled to upper ends of adjacent support columns 30a–30d and form, together with eave beam 22c which is shared by the first and second hexagonal building structures, a generally hexagonal shaped structure. A plurality of roof trusses 34a–34f are each coupled to a respective upper end of a support column 30a–30d and extend inwardly where they are joined together by means of a second compression ring 36. Each of the roof trusses is inclined upwardly as it extends inward toward the compression ring 36. As in the case of the first hexagonal building structure 12, the various aforementioned structural members are coupled together by conventional nut and bolt combinations which are not shown in FIG. 1 for simplicity. When a load is applied to the roof, the second inner compression ring 36 is placed in compression and an outer ring comprised of the support columns 30a–30d and eave beams 32a–32f is placed in tension, thus giving rise to the terms of art "compression" and "tension" rings.

As previously described, the first and second hexagonal building structures 12 and 14 make use of a common eave beam 22c as well as a pair of common support columns, only one of which is shown as element 20c in FIG. 1. The first and second hexagonal building structures 12 and 14 also share first and second building structure connector arrangements 18 and 42. An enlarged, exploded perspective view of the first building structure connector arrangement 18 is shown in FIG. 2 and described in detail in the following paragraphs.

Figure 2:
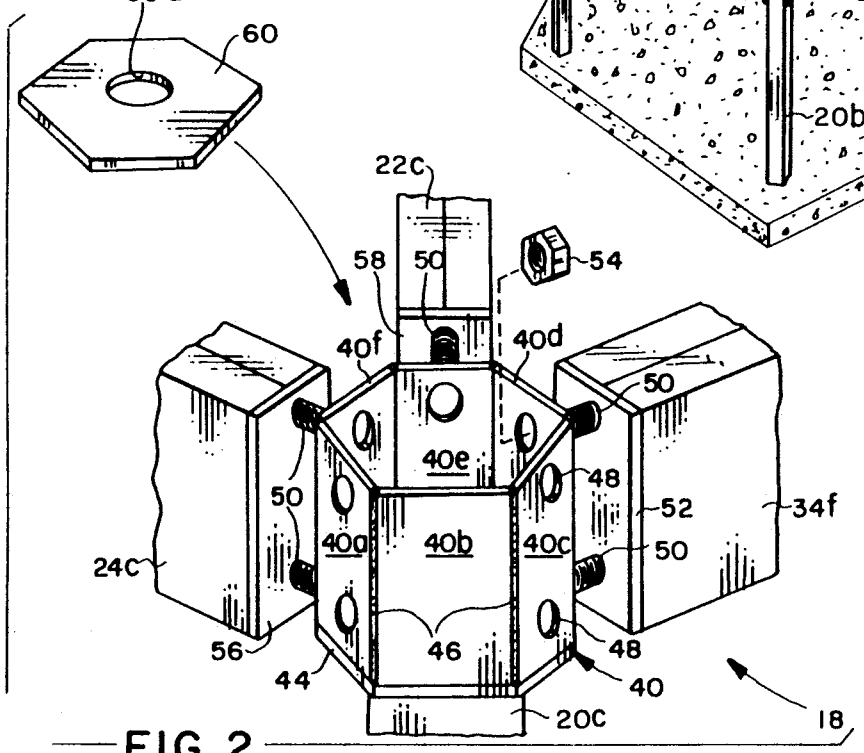
FIG. 2 is an exploded perspective view of a connector arrangement for use in interconnecting hexagonal building structures in accordance with the present invention.

As shown in FIG. 2, the building structure connector arrangement 18 includes a hexagonal shaped connector tube 40 comprised of a plurality of planar lateral walls 40a–40f each having a pair of apertures 48 therein. Lateral walls 40a, 40c and 40e are adapted to receive an end of a respective eave beam for connection thereto. Only eave beam 22c having an end plate 58 is shown for connection to lateral wall 40e of the connector tube 40, with the other two eave beams not shown for simplicity.

Lateral walls 40d and 40f of the connector tube 40 are adapted for coupling to roof trusses 24c and 34f. As shown in FIG. 2, each of the roof trusses 24c and 34f is inclined upwardly, while eave beam 22c is oriented generally transverse to support column 20c and connector tube 40 connected to an upper end of the support column.

Attached such as by weldments to the ends of roof trusses 24c and 34f are respective end plates 56 and 52. Each of the end plates 56 and 52 is provided with a pair of apertures therein through which a respective mounting bolt 50 is inserted for attachment to an adjacent lateral wall of the connector tube 40 by means of a nut 54. Similarly, the eave beam 22c is provided with an end plate 58 having a pair of apertures through each of which a respective bolt is inserted for insertion through an aperture in lateral wall 40e of the connector tube 40 and coupling thereto by means of a nut 54. In a preferred embodiment, a nut is positioned on the inner surface of an end plate over an aperture therein and is adapted to receive and engage a bolt inserted through the end plate and the connector tube 40. The connector tube 40 is provided with a lower plate, or cap, 44 for attachment by weldment to the support column 20c. The connector tube 40 may also be provided with an upper plate, or cap, 60 for completely enclosing the connector tube as well as the nut and bolt combinations attached thereto. The upper and lower plates 60, 44 of the connector tube 40 as well as the end plates of each of the eave beams and roof trusses are securely attached to their associated tube-like structural members by conventional means such as weldments. The upper, or stiffener, plate 60 is preferably positioned approximately $\frac{1}{3}$ the length of the connector tube 40 down from its upper end. The upper plate 60 serves to reinforce and strengthen the connector tube 40 and includes a 3-inch diameter access aperture 60a. The lower plate 44 is preferably welded to an upper end of the support column 20c. The lateral walls 40a–40f forming the connector tube 40 may also be securely coupled together by conventional means such as weldments 46. As shown in FIG. 2, the support column 22c is preferably comprised of a unitary, box beam-type of structural member having a generally square cross-section, while the upper support structures such as the eave beam 22c and the roof trusses 24c and 34f are comprised of lighter structures in the form of a pair of edge-to-edge coupled, elongated, generally linear C-beams. This welded C-beam construction in the form of unitary box beams reduces the weight of the upper structural members of the hexagonal building structure to facilitate construction and assembly thereof.

There has thus been shown an interconnection arrangement for a pair of hexagonal building structures wherein a common eave beam and support columns are used by both hexagonal building structures. The interconnection arrangement includes a closed, six-sided connector tube attached to a support column and having a plurality of lateral walls, each of which is provided with apertures for receiving a nut and bolt combination for coupling to an end of an eave beam or a roof truss. The hexagonal building structure interconnection arrangement includes a pair of such connector tubes mounted to the upper ends of adjacent support columns, which interconnection arrangement may be used to securely connect two hexagonal building structures.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A building structure comprising:

a first hexagonal building structure including a first plurality of support columns, eave beams and roof trusses;

a second hexagonal building structure including a second plurality of support columns, eave beams and roof trusses;

first and second connecting means for coupling an eave beam and first and second support columns forming portions of said first and second hexagonal building structures and connecting said first and second hexagonal building structures, wherein said first and second connecting means include respective connector tubes each having six lateral walls adapted for coupling to the ends of respective support columns, eave beams and roof trusses and wherein each of said connecting means further includes nut and bolt combinations for coupling the lateral walls of a connector tube to respective ends of said support columns, eave beams and roof trusses, each of said connector tubes including a lower cap coupled to an upper end of a support beam and cover means attached to an upper portion of said connector tube for enclosing said nut and bolt combinations within said connector tube.

2. The building structure of claim 1 wherein said first and second connecting means are attached to upper end portions of said first and second support columns, respectively.

3. The building structure of claim 1 wherein said cover means includes a stiffener plate inserted in an open upper portion of said connector tube for enclosing said nut and bolt combinations and increasing the strength of said connector tube.

4. The building structure of claim 1 wherein each connector tube is coupled to a support column and an eave beam forming a portion of said first and second hexagonal building structures and is further coupled to a roof truss of each of said first and second hexagonal building structures.

5. The building structure of claim 1 wherein each connector tube further includes a plurality of weldments coupling adjacent edges of the lateral walls thereof.

6. The building structure of claim 5 wherein each of said eave beams and roof trusses includes a respective end plate to facilitate coupling to said connector tube.

7. The building structure of claim 6 wherein said support columns are box beams and said roof trusses and eave beams are each comprised of a pair of C-beams coupled to a pair of weldments extending substantially the entire lengths thereof.

8. A connector arrangement for coupling first and second hexagonal building structures each including a plurality of support columns, eave beams and roof trusses, said connector arrangement comprising:

first and second six-side tubular connectors each having upper and lower cover plates so as to form an enclosed structure, wherein each side and the lower cover plate of each tubular connector includes an aperture therein; and coupling means including a plurality of nut and bolt combinations inserted through apertures in the sides and lower cover plate of said tubular connectors for connecting each of said tubular connectors to roof trusses, to a respective support column, and to opposed ends of the same eave beam, wherein said respective support columns and said same eave beam are structural members of said first and second hexagonal building structures, for coupling said first and second hexagonal building structures, and wherein said nut and bolt combinations are disposed within said enclosed structure.

9. The connector arrangement of claim 8 wherein adjacent, abutting edges of the sides and upper and lower cover plates of said tubular connectors are connected by weldments.

10. The connector arrangement of claim 8 wherein said upper cover plate is inserted within an upper portion of said tubular connector and is positioned in abutting contact with each side of a tubular connector for increasing the strength thereof.

11. The connector arrangement of claim 8 wherein each of said eave beams and roof trusses includes a respective end plate to facilitate coupling to a tubular connector.

12. The connector arrangement of claim 11 wherein the support columns are box beams and the roof trusses and eave beams are each comprised of a pair of C-beams coupled by a pair of weldments extending substantially the entire length thereof.

* * * * *